US006305598B1

(12) United States Patent
Bryan

(10) Patent No.: US 6,305,598 B1
(45) Date of Patent: Oct. 23, 2001

(54) STACKABLE PACKAGE CAPABLE OF DIVISION

(76) Inventor: Robert M. Bryan, 2531 Cottage Ave., Waverly, IA (US) 50677

( * ) Notice: Subject to any disclaimer, the term of this patent is extended or adjusted under 35 U.S.C. 154(b) by 0 days.

(21) Appl. No.: 09/785,948

(22) Filed: Feb. 20, 2001

(51) Int. Cl.[7] ..... B65O 5/4805

(52) U.S. Cl. ..... 229/120.011; 229/120.11; 229/915

(58) Field of Search ..... 229/120.01, 120.011, 229/120.11, 120.13, 120.18, 915, 919

(56) References Cited

U.S. PATENT DOCUMENTS

| | | | | |
|---|---|---|---|---|
| 3,158,312 | * | 11/1964 | Simkins | 229/120.18 |
| 4,228,945 | * | 10/1980 | Wysocki | 229/120.011 |
| 4,913,291 | * | 4/1990 | Schuster | 229/120.011 |
| 4,932,534 | * | 6/1990 | Focke et al. | 229/120.011 |
| 4,998,615 | * | 3/1991 | Bryan | 229/919 |
| 5,039,002 | * | 8/1991 | Spaner | 229/120.11 |
| 5,129,575 | * | 7/1992 | Bryan | 229/120.011 |
| 5,299,733 | * | 4/1994 | Werth | 229/120.011 |
| 5,722,583 | * | 3/1998 | Focke et al. | 229/120.011 |
| 6,006,982 | * | 12/1999 | Jones | 229/120.011 |

FOREIGN PATENT DOCUMENTS

| | | | |
|---|---|---|---|
| 1079540-B1 | * | 4/1960 | (DE) . |
| 739899-A | * | 11/1955 | (GB) . |
| 1106269-A | * | 3/1968 | (GB) . |

* cited by examiner

*Primary Examiner*—Gary E. Elkins

(57) ABSTRACT

A composite tray and stacker structure for packages of a plurality of identical paperboard and/or plastic containers supported in a tray for the purpose of providing compressive load-bearing capability to the package. The composite tray and stacker is composed essentially of a single sheet of stiff material, such as corrugated paperboard. The structure includes a rectangular tray bottom wall having a central transverse reverse fold line and a pair of end walls connected to the bottom wall along fold lines. A pair of top wall spacer elements are foldably connected along the top edges of the end walls and a pair of weight-bearing abutable stacker elements are foldably connected to the spacer elements. A relatively narrow product retainer panel is connected to each of the side edges of each of the end walls and stacker elements along fold lines. Relatively narrow rectangular flaps of equal width are connected along fold lines to the side edges of the bottom tray and in most instances also to the side edges of the top wall spacer elements. Gluing tabs are provided at the ends of the stacker elements for attachment to the bottom tray. Notches are provided in the retainer panels on opposite sides of one of the stacker elements. In the assembled package the end walls and spacer elements lie in parallel spaced apart relation to support packages stacked one on another. The rectangular flaps engage the outer surfaces of the product retainer panels. The assembled package encloses a pair of mirror image cells or compartments for product containers and is readily divisible into half packages.

11 Claims, 3 Drawing Sheets

STACKABLE PACKAGE CAPABLE OF DIVISION

FIELD OF THE INVENTION

BACKGROUND OF THE INVENTION

This invention relates to an improved composite tray and stacker for packages or cartons of a plurality of identical paperboard and/or plastic containers supported in the tray for the purpose of providing compressive load-bearing capability to the package. The package of this invention is characterized by its capability of being divided into half packages.

In recent years there has been a proliferation of brands and varieties of products within a single brand. Examples are plain cereal, cereal with raisins, cereal with fruit and nuts, etc., and products which come in a variety of flavors. Many smaller stores have difficulty coping with full cases of these products, creating demands for half cases. The same problem exists for some relatively slow moving products.

The present invention is directed to an improved stackable package constructed from a single piece of corrugated sheet material, which is readily divided into two halves. It is adapted to use with heavy products, such as large sizes of liquids like milk, juices, etc., which are more readily handled in half size cartons.

THE PRIOR ART

The prior art is exemplified by my Pat. No. 5,129,575 issued Jul. 14, 1992, which is directed to a composite tray and stacker structure for packages of a plurality of identical paperboard and/or plastic containers supported in a tray for the purpose of providing compressive load-bearing capability to the package. The composite tray and stacker is composed essentially of a single sheet of stiff material, such as corrugated paperboard. The structure includes a rectangular tray bottom wall having a central transverse reverse fold line and a pair of end walls connected to the bottom wall along fold lines. A pair of top wall spacer elements are foldably connected along the top edges of the end walls and a pair of weight-bearing abutable stacker elements are foldably connected to the spacer elements. A relatively narrow product retainer panel is connected to each of the side edges of each of the end walls and stacker elements along fold lines. Relatively narrow rectangular flaps are connected along fold lines to the side edges of the bottom tray and in most instances also to the side edges of the top wall spacer elements. In the assembled package the end walls and spacer elements lie in parallel spaced apart relation to support packages stacked one on another. The rectangular flaps engage the outer surfaces of the product retainer panels. The assembled package encloses a pair of mirror image cells or compartments for product containers and is readily divisible into half packages.

The present invention represents a modification of and improvement over the package of U.S. Pat. No. 5,129,575.

SUMMARY OF THE INVENTION

Sharing much of the structure of the package of U.S. Pat. No. 5,129,575 the present invention is likewise directed to a package of a plurality of identical paperboard and/or plastic containers contained in a tray with a composite built-in stacker structure. The composite tray and stacker structure includes a rectangular tray bottom wall having a central transverse reverse fold line with a pair of relatively wide rectangular end walls connected along their bottom edges to opposite ends of the tray bottom wall along spaced apart parallel fold lines. The end walls are of a width approximately equal to the height of the containers to be packaged. A pair of rectangular top wall spacer elements are each connected along one edge to the top edge of each of the end walls along a fold line. A pair of rectangular weight-bearing stacker elements are each connected to one of the spacer elements along a fold line opposite from the spacer connection to the end walls. The width of the stacker elements is approximately equal to the width of the end walls. The stacker elements abut in the center of the package.

As in the earlier package, a relatively narrow product retainer panel is connected to each of the side edges of each of the end walls and stacker elements along fold lines. There are provided relatively narrow rectangular flaps connected to the side edges of the bottom tray and also to the side edges of each of the top wall spacer elements. In the assembled package these flaps fold over and are fastened to the product retainer panels.

In the package of the prior patent certain of the product retainer panels are wider than other retainer panels to facilitate the plow and tuck operations of the package machine in the assembly of the package. The wider panels are eliminated in the present package blank and replaced by notches in the product retainer panels connected to one of the stacker elements for the same purpose. This reduces the overall size of the paperboard blank resulting in material savings of up to ten percent, making the present package more economically and environmentally friendly by reducing the total material initially required and reducing the amount of waste.

In the package of the prior patent no provision is made for sealing the seams between the bottoms of the stacker elements and the bottom tray. When the package is split into halves, the open seam may be spread into a gap which some unscrupulous customers may use to pilfer flat objects, such as CDs and the like. This open seam is eliminated in the package of the present invention.

The present divisible package also often eliminates the need for a separate inner package commonly used for beverage six-packs and the like.

BRIEF DESCRIPTION OF THE DRAWING

The invention is illustrated in the accompanying drawings in which corresponding parts are identified by the same numerals and in which.

DETAILED DESCRIPTION OF THE PREFERRED EMBODIMENT

Figure 1:
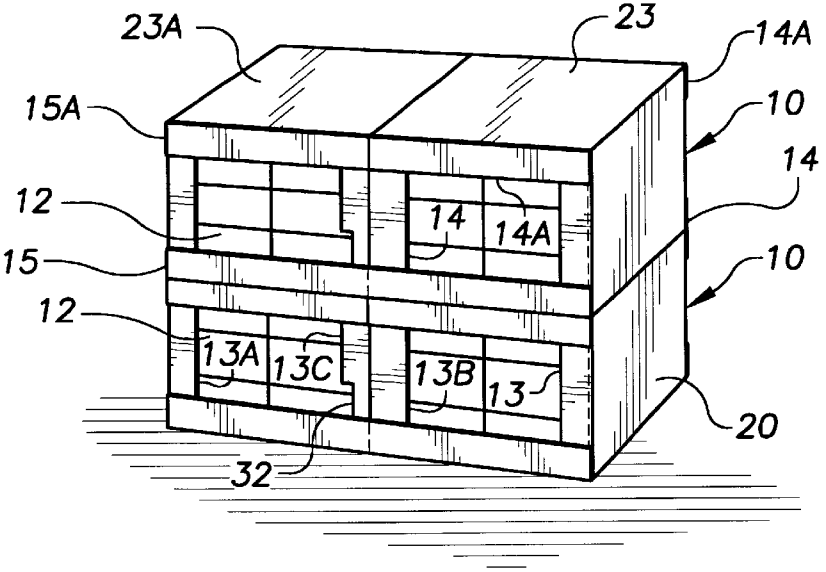
FIG. 1 is a perspective view showing two typical packages according to the present invention stacked one upon the other.

Referring now to the drawings, and particularly to FIG. 1, there is shown a pair of typical divisible packages according to the present invention, indicated generally at 10, stacked one upon the other. The package includes a flat tray portion and an integral stacker structure formed from a single sheet of stiff sheet material. A plurality of identical paperboard and/or plastic product containers 12 are supported within the tray portion of the package. As explained in detail hereinafter, a plurality of relatively narrow product retainer panels 13–13C and flaps 14 and 14A and 15 and 15A hold the containers within the package.

Figure 2:
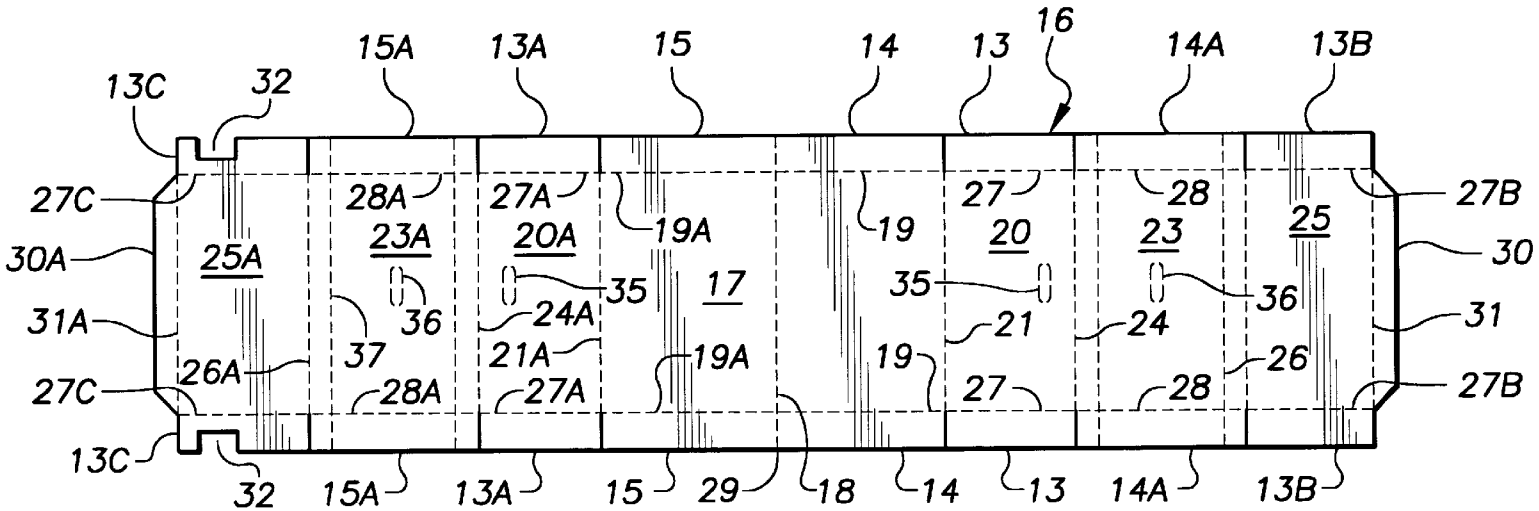
FIG. 2 is a plan view of a sheet material blank from which a divisible composite tray and stacker may be formed, showing optional hand-holds and tear strips which may be used.
Figure 3:
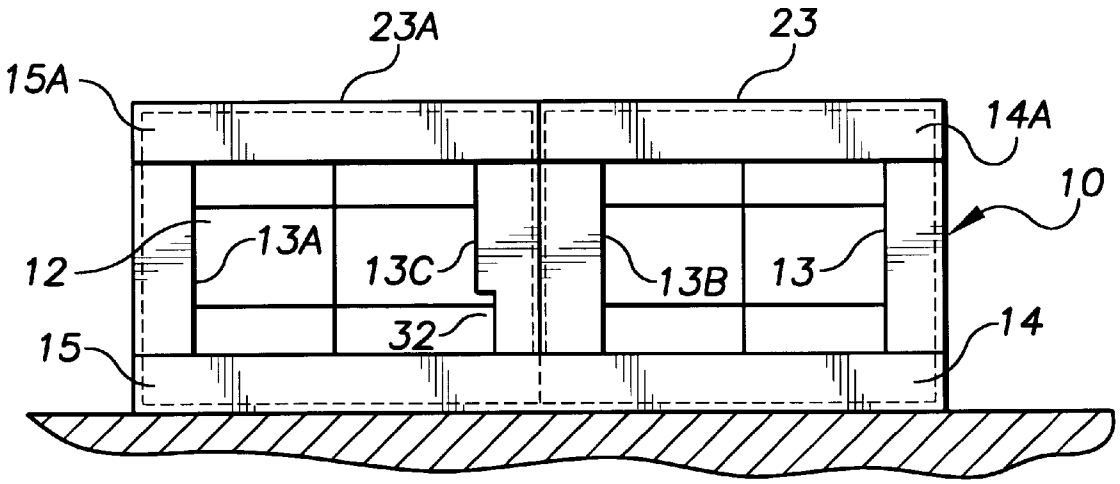
FIG. 3 is a front elevation of an assembled tray and stacker.
Figure 4:
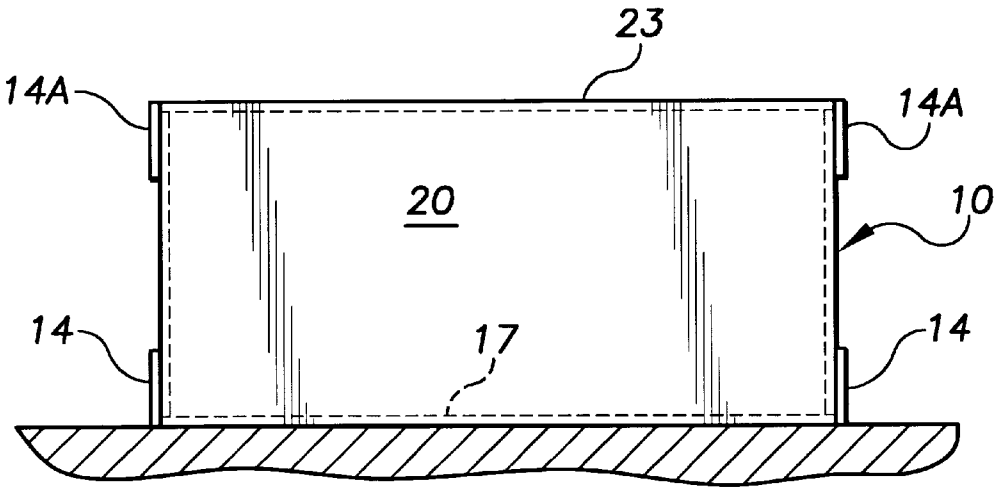
FIG. 4 is an end elevation thereof.

Referring to FIG. 2, there is shown a blank 16 from which the divisible composite tray and stacker is assembled. The blank includes a rectangular tray bottom wall section 17. To facilitate loading, tray bottom wall 17 has a central transverse fold line 18, by which the tray may be slightly humped.

A pair of narrow rectangular flaps 14 (narrow relative to the width of bottom tray 17) are connected to opposite side edges of the bottom tray section, on one side of reverse fold line 18, along fold lines 19. Another pair of narrow rectangular flaps 15 are connected to opposite side edges of the bottom tray section, on the opposite side of reverse fold line 18, along fold lines 19A. Flaps 14 and 15 extend horizontally across the front and back faces of the assembled package along the bottom edge thereof. Flaps 14 and 15 should preferably be joined along extensions of reverse fold line 18, which may be perforated.

The end wall sections 20 and 20A of the blank are connected to the tray bottom wall portion along spaced apart parallel fold lines 21 and 21A, respectively. A pair of top wall spacer elements 23 and 23A are each connected along fold lines 24 and 24A, respectively, to the adjacent end wall sections 20 and 20A. A pair of stacker elements 25 and 25A are connected along fold lines 26 and 26A, respectively, to the next adjacent spacer elements 23 and 23A. The widths of the stacker elements 25 and 25A are approximately equal to the widths of the end wall portions 20 and 20A. The combined widths of the top wall spacer elements 23 and 23A are approximately equal to the length of the tray bottom wall section 17. This form of package is adapted to the packaging of containers 12 arrayed on the bottom wall of the tray in an even numbered series of rows.

The illustrated containers 12 are relatively flat rectangular boxes stacked in two rows of three boxes in each half of the package. The containers may be vertically arrayed boxes; or cartons such as used to dispense liquids such as milk or juices; or jugs such as used to dispense milk, distilled water, juices, etc., or bottles used to dispense cooking and lubricating oils, shampoos and other hair care products, detergents, etc.; deodorant containers, toothpaste pumps, and the like. Large containers may be shipped in packages of only four, or even two, containers per package.

A pair of relatively narrow rectangular product retainer panels 13 and 13A, which extend vertically in the assembled package, are co-extensive with each side edge of both end wall sections 20 and 20A, respectively, and are connected to the end walls by fold lines 27 and 27A, respectively. Similarly, a pair of like retainer panels 13B and 13C are co-extensive with each side edge of both stacker elements 25 and 25A, respectively, and are connected thereto by fold lines 27B and 27C, respectively.

Retainer panels 13–13C are each of a width no more than one fourth the length of the bottom tray wall 15. Depending upon the product to be packaged they may be only wide enough to securely retain the packaged containers within the assembled package. This leaves a substantial gap or window in each half face of the assembled package through which the packaged product is visible and may be displayed when the package itself is used as a display in lieu of shelving the containers.

A further pair of narrow rectangular flaps 14A and 15A, which extend horizontally across the front and back faces of the assembled package along the top edge thereof, are co-extensive with each side edge of both top wall spacer elements 23 and 23A, respectively, and are connected to the top walls by fold lines 28 and 28A, respectively.

All of the product retainer panels 13, 13A, 13B and 13C, and flaps 14, 14A, 15 and 15A are of the same width.

Although flaps 14 and 15 are shown as separated only buy a score line or perforation to facilitate separation of the divisible package, in some instances a slot may be provided between flaps 14 and 15 to facilitate assembly and separation of the package.

The width of flaps 14, 14A, 15 and 15A is no more than one half the width of end walls 20 and 20A and stacker elements 25 and 25A to avoid overlapping. Preferably they are only wide enough to securely retain the packaged containers within the assembled package. As in the case of retainer flaps 13–13C, and in cooperation therewith, this may leave a substantial gap or window in each half face of the assembled package through which the packaged product is visible and may be displayed when the package itself is used as a display in lieu of shelving the containers, or the ends of the packages may be substantially closed. Increasingly it is required that a UPC (Universal Product Code) be applied to each side of a package. Flaps 14 and 15 are preferably wide enough to receive the UPC.

Figure 5:
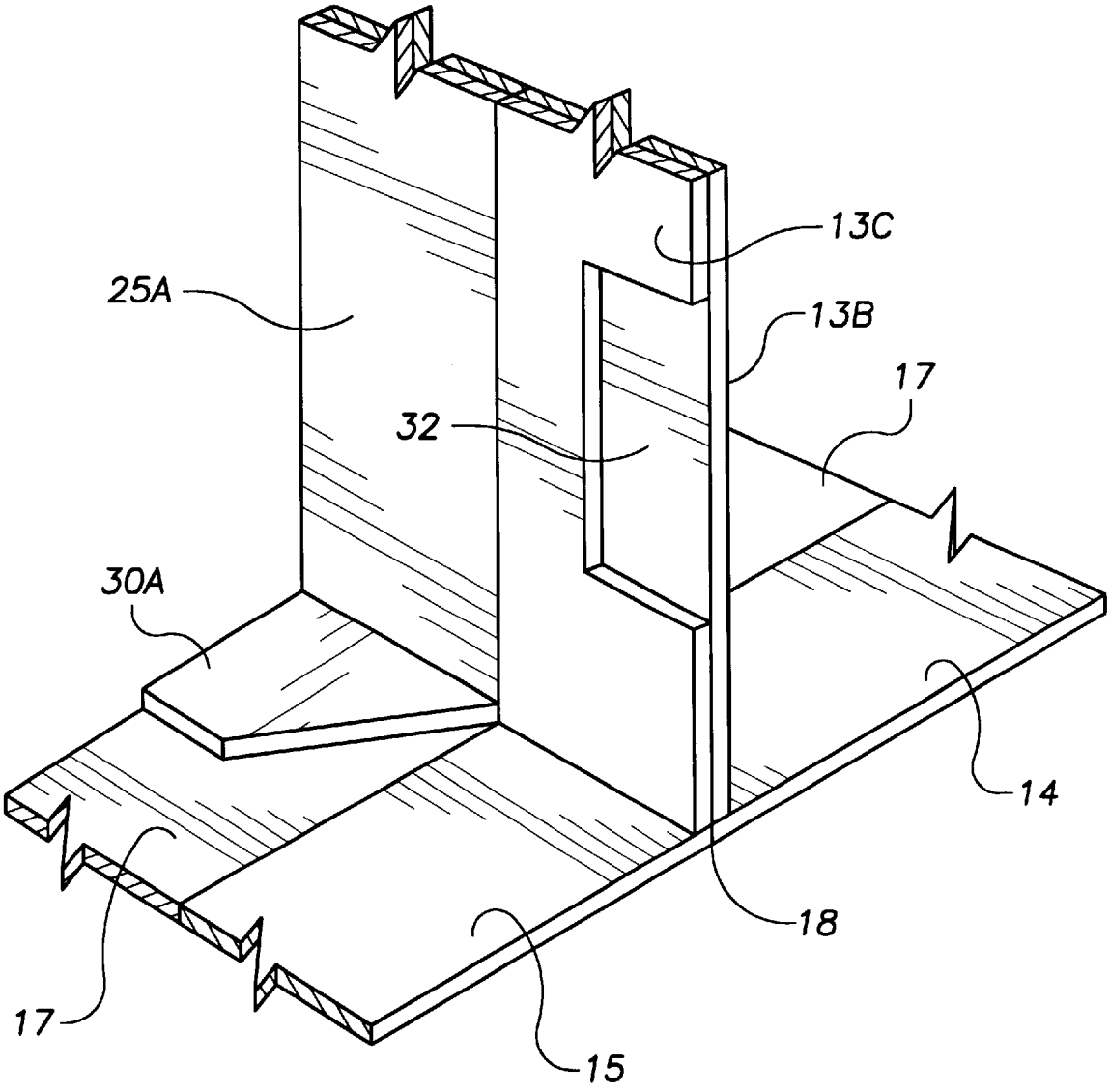
FIG. 5 is an enlarged fragmentary isometric view of the joint between the bottom ends of the stacker elements and tray bottom wall.

A rectangular gluing flap or tab 30 is provided, connected along fold line 31 to stacker element 25. A similar gluing flap or tab 30A is provided, connected along fold line 31A to stacker element 25A. In the assembled package the gluing tabs are secured by means of glue or other adhesive to the top surface of bottom tray 17 on opposite sides of fold line 18, in a manufacturers joint or hinge joint as seen in FIG. 5. When the package is divided into halves, the closed seam between the stacker elements and bottom tray wall prevents pilfering of thin objects by slipping them into the heretofore open seam.

A rectangular notch 32 is provided in the outer edges of product retainer panels 13C. The notches are narrower in depth than the width of the retainer panels and are spaced from the ends of the retainer panels adjacent to the gluing tab 30A. Notches 23 facilitate the plow and tuck operations of the package making machine in the assembly of the package.

In assembling the package, the end walls 20 and 20A are folded along fold lines 21 and 21A, respectively, to extend vertically relative to the horizontal tray bottom wall 17. The stacker elements 25 and 25A are folded along fold lines 26 and 26A, respectively, to extend at right angles to the top wall spacer elements 23 and 23A which are folded along fold lines 24 and 24A, respectively, to extend horizontally at right angles relative to the top edges of the side walls 20 and 20A.

A narrow bead or strip of glue or other adhesives as are commonly used in the packaging industry is applied to the gluing tabs 30 and 30A and the bottom ends of the stacker elements are attached to the bottom tray wall 17. The partially assembled package blank is commonly collapsed flat and shipped to the product packer in this form.

The product packer opens the collapsed blank and insert the product containers 12 into the two cells or compartments of the package. A bead or strip of glue or other adhesive is applied to the top edge of one of stacker elements 25 or 25A along fold line 27 or 27A to secure the stacker elements in face-to-face abutting relation, but permitting later separation to divide the assembled package into halves.

Retainer panels 13–13C are folded inwardly along fold lines 27–27C, respectively. Flaps 14 and 15 are folded inwardly and upwardly along fold lines 19 and 19A, respectively, and are secured by glue or other adhesive to the outside surfaces of panels 13–13C adjacent to the bottom edges thereof. Flaps 14A and 15A are folded inwardly and downwardly along fold lines 28 and 28A, respectively, and are secured to the outside surfaces of panels 13–13C adjacent to the top edges thereto.

In so assembling the package, the weight-bearing stacker elements 25 and 25A extend vertically downwardly to the tray bottom wall. The combination of the abutting stacker elements 25 and 25A along with end walls 20 and 20A, both strengthened by retainer panels 13–13C, permits stacking of packages on top of the package top wall formed by spacer elements 23 and 23A. The packaged containers are securely held in the mirror image cells defined by the bottom tray 17, top wall spacers 23 and 23A, end walls 20 and 20A, stacker elements 25 and 25A, retainer panels 13–13C, and flaps 14, 15, 14A and 15A.

Upon arrival at the distribution point for the packaged and containers, if customer requirements so demand, the packages are easily divisible into halves. The abutting stacker elements 25 and 25A are readily separated by tearing apart the narrow glue line joining them at their top edges. A cut may be made along the reverse fold line 18, or preferably the reverse fold line is perforated to permit easy separation of the bottom tray 17. In this manner retailer demands for half cartons of products can be satisfied while maintaining the integrity of the packages until they reach their final destination.

The relative sizes and proportions of the various package components: bottom tray, end walls, top walls, stackers, retainer panels, and flaps, depend upon the products to be packaged and the number of units to be enclosed in a single package. Where the products are heavy hand-holds 35 may optionally be provided in the end walls 20 and 20A, either by whole or partial die cuts or perforations, to facilitate handling of the packages. Similarly, hand-holds 36 may optionally be provided in the center of the top walls 23 and 23A to facilitate carrying of relatively bulky and heavy products as gallon sizes of milk or juices, or the like. These products may be purchased by the ultimate consumer in half cartons, and taken home without the necessity of opening the package. In some instances a twin-pack may be desirable. In this case the hand-holds are located closely spaced apart on opposite sides of the seam formed by the abutting spacer elements.

Where the packaged product may be sold to the consumer without removal from the package and shelving, transverse perforations 37 are provided in the top wall spacer elements 23 and 23A and attached flaps 14A and 15A, spaced inwardly from fold lines 24, 24A, 26 and 26A by a distance about equal to the width of retainer panels 13–13C. When the package reaches the sales floor the panel between perforations 37 can readily be removed by tearing the perforations, converting the package into a display from which the product containers are easily removed by the purchaser.

The blank 16 is composed essentially of stiff sheet material, such as corrugated cardboard as is commonly used in the packaging industry. Ordinarily, where the packages are intended to be stored with the trays disposed horizontally and stacked one on top of the other, the corrugations extend vertically for maximum strength. Blank 16 is die cut from corrugated stock with minimum waste. That minimum waste is recyclable.

It is apparent that many modifications and variations of this invention as hereinbefore set forth may be made without departing from the spirit and scope thereof. The specific embodiments described are given by way of example only and the invention is limited only by the terms of the appended claims.

What is claimed is:

1. A composite tray and stacker structure for a divisible stackable package of a plurality of identical containers, said structure having inside and outside surfaces and comprising:

A) a rectangular tray bottom wall having side and end edges;

B) a central transverse reverse fold line across the tray bottom wall;

C) a pair of rectangular end walls having top, bottom and side edges, said end walls being connected along their bottom edges to opposite ends of said bottom wall along spaced apart parallel fold lines and folded upwardly from said bottom wall, said end walls being of a width approximately equal to the height of the containers to be packaged;

D) a pair of relatively narrow end wall product retainer panels co-extensive with and connected to each side edge of both of said end walls, each connected along a fold line at the respective side edges of the end walls and folded inwardly from the end walls;

E) a pair of rectangular spacer elements comprising the top wall of said package, said spacer elements having front, back and end edges, each of said spacer elements being connected along one end edge to one of said end walls along a fold line at the top edge of each of the end walls and folded inwardly from the tops of the end walls, the total width of said spacer elements being equal to the length of the bottom tray;

F) a pair of rectangular weight-bearing stacker elements each connected to one of said top wall spacer elements along a fold line along the edge thereof which is opposite from the end edge connecting the spacer element to the end wall and folded downwardly from the top wall into abutment with each other, the width of said stacker elements being approximately equal to the width of the end walls;

G) a pair of rectangular gluing tabs each connected to one of said stacker elements along a fold line spaced from and parallel to the fold lines between said stacker elements and said top wall spacer elements, said gluing tabs being folded inwardly and in abutment with the top surface of said tray bottom wall adjacent to and on opposite sides of said reverse fold line;

H) a pair of relatively narrow product retainer panels co-extensive with and connected to each side edge of both of said stacker elements, each being connected along a fold line at the respective side edges of the stacker elements and folded inwardly from the stacker elements, said stacker element retainer panels being of a width substantially the same as said end wall retainer panels;

I) a pair of notches in the edges of each of said stacker element retainer panels of one of said stacker elements, said notches being in the edge opposite from the fold line connecting said panels to the stacker elements, said notches being narrower in depth than the width of the retainer panels and spaced from the ends of retainer panels adjacent to the gluing tab;

J) a pair of relatively narrow product retainer flaps co-extensive with and connected to each side edge of each of said top wall spacer elements along fold lines at the side edges of said top wall spacer elements, said top wall retainer flaps being of a width substantially the same as said end wall and stacker element retainer panels, and said top wall retainer flaps extending over and in abutment with the top ends of said end wall and stacker element retainer panels; and K) a pair of relatively narrow bottom wall product retainer flaps of a width substantially the same as said top wall retainer flaps and said end wall and stacker element retainer panels, said bottom wall flaps being co-extensive with and connected to each side edge of said tray bottom wall along fold lines at the side edges of the bottom wall, said bottom wall retainer flaps extending over and in abutment with the bottom ends of said end wall and stacker element retainer panels.

2. A composite tray and stacker structure according to claim 1 wherein said reverse fold line extends through said bottom wall product retainer flaps and is perforated.

3. A composite tray and stacker structure according to claim 1 wherein said notches in the stacker element retainer panels are rectangular.

4. A composite tray and stacker structure according to claim 1 wherein:

A) said flaps connected to said tray bottom wall and to said top wall spacer elements are of a width no more than one half the width of said end walls and stacker elements; and B) said retainer panels connected to said end walls and stacker elements are of a width no more than one fourth the length of said tray bottom wall along the side edges thereof.

5. A composite tray and stacker structure according to claim 1 wherein said structure is comprised of corrugated board, the corrugations of which extend parallel to the direction of the bottom wall side edges, whereby the package has maximum load-bearing capability when stacked with its bottom wall horizontal.

6. In combination:

A) a composite tray and stacker structure according to claim 1; and

B) a plurality of identical product container supported on the bottom wall of the tray between the side edges and end walls thereof, the stacker elements separating said containers into an equal number of containers.

7. A corrugated paperboard blank for forming a composite tray and stacker structure for a divisible stackable package of a plurality of identical containers, said blank comprising:

A) a rectangular tray bottom wall panel having side and end edges:

B) a central transverse reverse fold line across the tray bottom wall panel:

C) a pair of rectangular end wall panels having top, bottom and side edges, said end wall panels being connected along their bottom edges to opposite ends of said bottom wall panel along spaced apart parallel fold lines, said end wall panels being of a width approximately equal to the height of the containers to be packaged;

D) a pair of relatively narrow end wall product retainer panels co-extensive with and connected to each side edge of both of said end wall panels, each connected along a fold line at the respective side edges of the end wall panels;

E) a pair of rectangular spacer element panels comprising the top wall of said package, said spacer element panels having front, back and end edges, each of said spacer element panels being connected along one end edge to one of said end wall panels along a fold line at the top edge of each of the end wall panels, the total width of said spacer element panels being equal to the length of the bottom tray panel;

F) a pair of rectangular weight-bearing stacker element panels each connected to one of said top wall spacer element panels along a fold line along the edge thereof which is opposite from the end edge connecting the spacer element panels to the end wall panels, the width of said stacker element panels being approximately equal to the width of the end of wall panels;

G) a pair of rectangular gluing tabs each connected to one of said stacker element panels along a fold line spaced from and parallel to the fold lines between said stacker element panels and said top wall spacer element panels;

H) a pair of relatively narrow product retainer panels co-extensive with and connected to each side edge of both of said stacker element panels, each being connected along a fold line at the respective side edges of the stacker element panels, said stacker element retainer panels being of a width substantially the same as said end wall retainer panels;

I) a pair of notches in the edges of each of said stacker element retainer panels of one of said stacker elements, said notches being in the edge opposite from the fold line connecting said panels to the stacker element panels, said notches being narrower in depth than the width of the retainer panels and spaced from the ends of retainer panels adjacent to the gluing tab;

J) a pair of relatively narrow product retainer flaps co-extensive with and connected to each side edge of each of said top wall spacer element panels along fold lines at the side edges of said top wall spacer element panels, said top wall retainer flaps being of a width substantially the same as said end wall and stacker element retainer panels; and K) a pair of relatively narrow bottom wall product retainer flaps of a width substantially the same as said top wall retainer flaps and said end wall and stacker element retainer panels, said bottom wall flaps being co-extensive with and connected to each side edge of said tray bottom wall panel along fold lines at the side edges of the bottom wall panel.

8. A blank according to claim 7 wherein said reverse fold line extends through said bottom wall product retainer flaps and is perforated.

9. A blank according to claim 7 wherein said notches in the stacker element retainer panels are rectangular.

10. A blank according to claim 7 wherein:

A) said flaps connected to said tray bottom wall panel and to said top wall spacer element panels are of a width no more than one half the width of said end wall and stacker element panels; and B) said retainer panels connected to said end wall and stacker element panels are of a width no more than one fourth the length of said tray bottom panel wall along the side edges thereof.

11. A blank according to claim 7 wherein the corrugations of said corrugated board extend parallel to the direction of the bottom wall panel side edges.

* * * * *